US011541656B2

(12) United States Patent
Ishiwata et al.

(10) Patent No.: US 11,541,656 B2
(45) Date of Patent: Jan. 3, 2023

(54) RECORDING APPARATUS AND METHOD OF CONTROLLING RECORDING APPARATUS

(71) Applicant: CANON KABUSHIKI KAISHA, Tokyo (JP)

(72) Inventors: Tomoki Ishiwata, Kawasaki (JP); Takatsugu Moriya, Tokyo (JP); Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 6 days.

(21) Appl. No.: 17/017,049

(22) Filed: Sep. 10, 2020

(65) Prior Publication Data

US 2021/0086508 A1 Mar. 25, 2021

(30) Foreign Application Priority Data

Sep. 19, 2019 (JP) ..... JP2019-170514

(51) Int. Cl.
*B41J 2/045* (2006.01)
*B41J 2/165* (2006.01)
*B41J 2/14* (2006.01)

(52) U.S. Cl.
CPC ..... *B41J 2/04563* (2013.01); *B41J 2/0451* (2013.01); *B41J 2/04541* (2013.01); *B41J 2/04555* (2013.01); *B41J 2/04573* (2013.01); *B41J 2/16517* (2013.01); *B41J 2/04516* (2013.01); *B41J 2002/14475* (2013.01)

(58) Field of Classification Search
CPC ..... B41J 2/04563
See application file for complete search history.

(56) References Cited

U.S. PATENT DOCUMENTS 6,086,180 A * 7/2000 Sugimoto ..... B41J 2/04573 347/14
9,597,871 B2 * 3/2017 Ike ..... B41J 2/0458
2007/0120893 A1 * 5/2007 Chou ..... B41J 2/0451 347/61

(Continued)

FOREIGN PATENT DOCUMENTS

DE 102005038664 A1 * 3/2006 ..... B41J 2/04563
JP 2011-207235 A 10/2011

*Primary Examiner* — Shelby L Fidler
(74) *Attorney, Agent, or Firm* — Canon U.S.A., Inc. I.P. Division

(57) ABSTRACT

A recording apparatus includes a liquid ejection head, where the liquid ejection head includes: an ejection port, a first substrate, and a temperature detection element. The ejection port ejects liquid and includes a protrusion extending toward an ejection port inside. The first substrate includes a heating element that ejects liquid from the ejection port using heat. The temperature detection element detects temperature of the first substrate. Driving of the heating element is controlled based on whether a difference between a voltage value Vp1 measured by the temperature detection element and a preset voltage value Vp01 has a positive value within or outside a predetermined range or a negative value outside the predetermined range. The voltage value Vp1 is measured when a temperature change amount becomes maximum in a temperature falling process of a second substrate located, after the heating element is driven, at a position corresponding to the heating element.

4 Claims, 11 Drawing Sheets

(56) References Cited

U.S. PATENT DOCUMENTS

| | | | | |
|---|---|---|---|---|
| 2008/0291245 | A1* | 11/2008 | Takei | B41J 2/1433 347/47 |
| 2010/0194810 | A1* | 8/2010 | Takabayashi | B41J 2/0458 347/14 |
| 2013/0135376 | A1* | 5/2013 | Ike | B41J 2/04563 347/14 |
| 2013/0194335 | A1* | 8/2013 | Nodsu | B41J 2/0458 347/14 |
| 2014/0300657 | A1* | 10/2014 | Ike | B41J 2/14153 347/14 |
| 2018/0339526 | A1* | 11/2018 | Kano | B41J 2/195 |
| 2019/0299590 | A1* | 10/2019 | Oikawa | B41J 2/0451 |

* cited by examiner

RECORDING APPARATUS AND METHOD OF CONTROLLING RECORDING APPARATUS

BACKGROUND

Field

The present disclosure relates to a recording apparatus including a liquid ejection head that is provided with an ejection port having a protrusion, and to a method of controlling the recording apparatus.

Description of the Related Art

A recording apparatus that ejects liquid (liquid droplets) to perform recording includes a liquid ejection head that is provided with an ejection port to eject the liquid. When the liquid droplets are ejected from the ejection port, main liquid droplets contributing to recording are ejected, and small droplets that are called satellite droplets may be generated. If the generated satellite droplets adhere to a recording medium such as a sheet, recording quality may be deteriorated.

Japanese Patent Application Laid-Open No. 2011-207235 discusses a configuration in which a protrusion is provided at an ejection port in order to prevent generation of the satellite droplets. Preventing generation of the satellite droplets makes it possible to improve print quality.

In a case where the protrusion provided at the ejection port of the recording apparatus discussed in Japanese Patent Application Laid-Open No. 2011-207235 receives stress from outside, the protrusion may be damaged. If the protrusion is damaged, it is difficult to prevent generation of the satellite droplets, which may cause deterioration in recording quality. However, it is difficult to check the damage of the protrusion in the recording apparatus, and the recording may be continued in the damaged state.

SUMMARY

The present disclosure is directed to a recording apparatus capable of preventing deterioration in recording quality caused by damage of the protrusion.

According to an aspect of the present disclosure, a recording apparatus includes a liquid ejection head, wherein the liquid ejection head includes: an ejection port configured to eject liquid and including a protrusion extending toward an inside of the ejection port, a first substrate including a heating element configured to heat the liquid to eject the liquid from the ejection port, and a temperature detection element configured to detect temperature of the first substrate, wherein driving of the heating element is controlled based on whether a difference between a voltage value Vp1 measured by the temperature detection element and a preset voltage value Vp01 has a positive value within or outside a predetermined range or a negative value outside the predetermined range, where the voltage value Vp1 is measured by the temperature detection element at a timing when a temperature change amount becomes maximum in a temperature falling process of a second substrate located, after a driving operation to drive the heating element, at a heating element position corresponding to the heating element driven in the driving operation.

Further features of the present disclosure will become apparent from the following description of exemplary embodiments with reference to the attached drawings.

DESCRIPTION OF THE EMBODIMENTS

Exemplary embodiments of the present disclosure are described below with reference to drawings. In the following description, an inkjet printer that includes a liquid ejection head ejecting ink is described as an example of a recording apparatus that ejects liquid to perform recording.

<Recording Apparatus>

Figure 1:
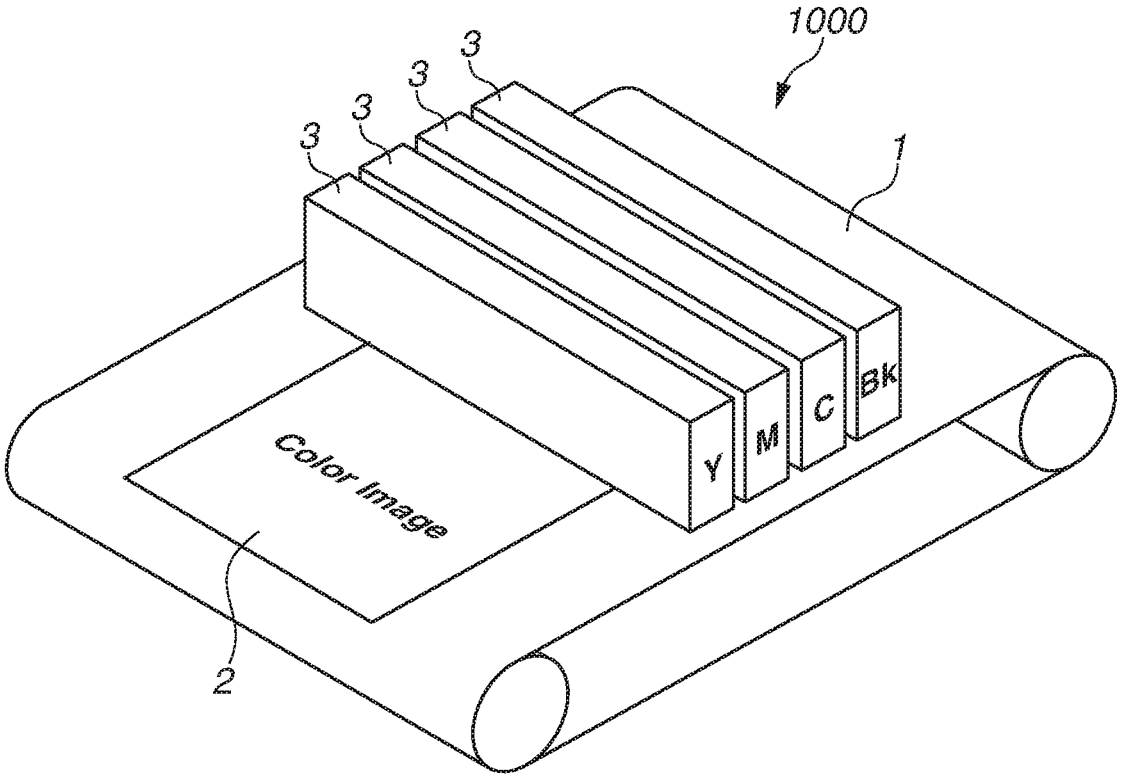
FIG. 1 is a diagram schematically illustrating a configuration of a recording apparatus according to a first exemplary embodiment.

A recording apparatus according to a first exemplary embodiment is described with reference to FIG. 1. FIG. 1 is a schematic diagram illustrating a recording apparatus 1000 according to the present exemplary embodiment. The recording apparatus 1000 is an inkjet printer that mainly includes a conveyance unit 1 conveying a recording medium 2 such as a sheet, and liquid ejection heads 3 each configured to eject liquid (ink). The liquid ejection heads 3 are so-called page-wide heads each having a length greater than or equal to a width of the recording medium 2. The recording apparatus 1000 includes four single-color liquid ejection heads 3 corresponding to cyan (C), magenta (M), yellow (Y), and black (K), and can perform color printing.

<Liquid Ejection Head>

Figure 2:
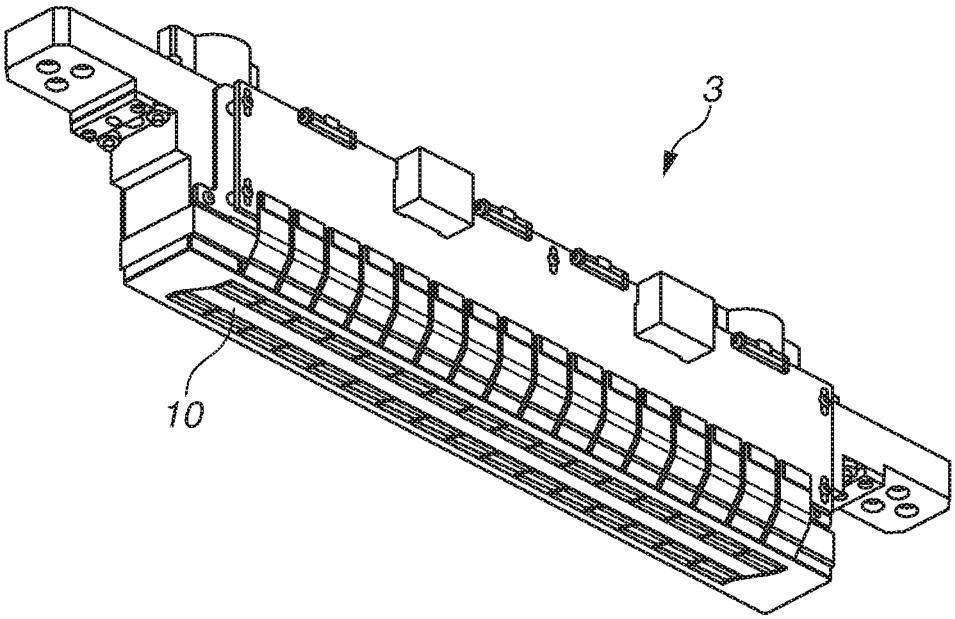
FIG. 2 is a perspective view of a liquid ejection head according to the first exemplary embodiment.

Each of the liquid ejection heads 3 according to the present exemplary embodiment is described with reference to FIG. 2. FIG. 2 is a schematic diagram illustrating one liquid ejection head 3 according to the present exemplary embodiment. The liquid ejection head 3 includes 16 recording element substrates 10 arranged in a longitudinal direction of the liquid ejection head 3. Each of the recording element substrates 10 includes an ejection port 13 (FIGS. 3A, 3B, and 3C) for ejecting ink, and a heating element 15 (FIG. 3A) for heating the ink. Each of the recording element substrates 10 drives the heating element 15 to heat the ink, thereby ejecting the ink from the ejection port 13. The driving of the heating element 15 is controlled by a control element (not illustrated). The control element is included in the liquid ejection head 3 or the recording apparatus 1000.

<Recording Element Substrate>

Figure 3A:
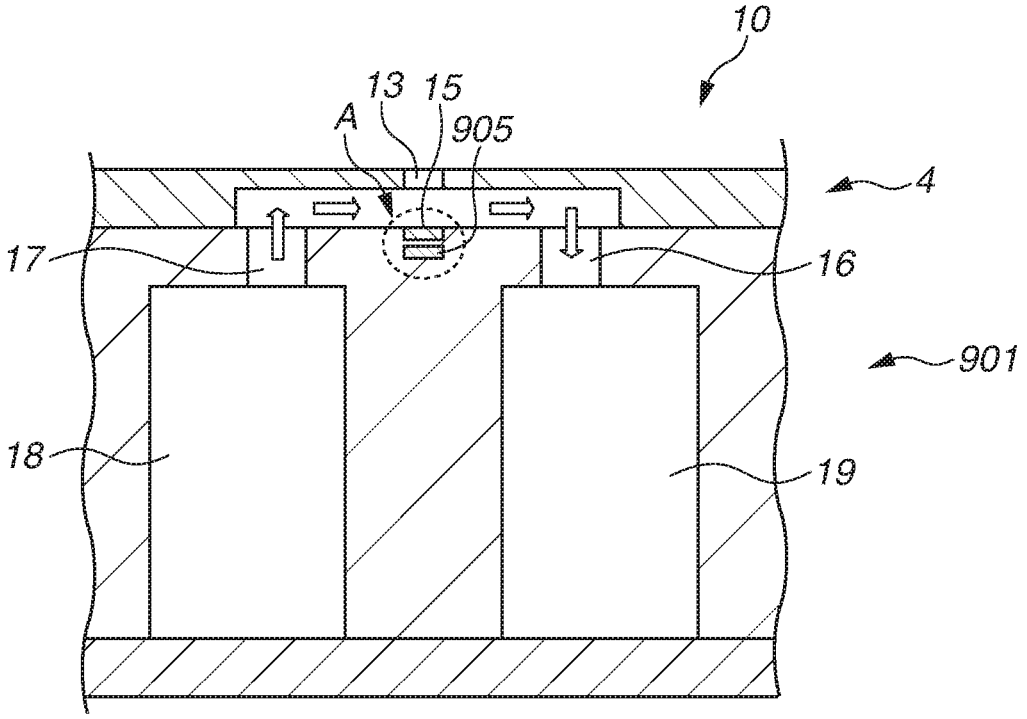
FIG. 3A is a diagram illustrating a configuration of a recording element substrate.
Figure 3B:
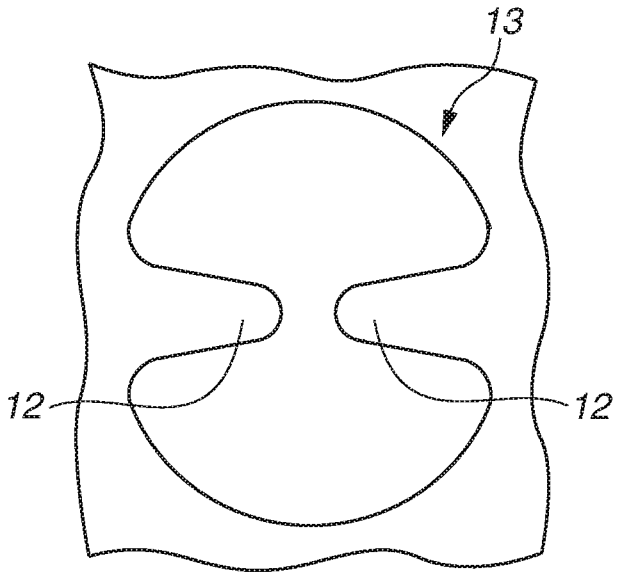
FIGS. 3B and 3C are diagrams each illustrating an ejection port.
Figure 3C:
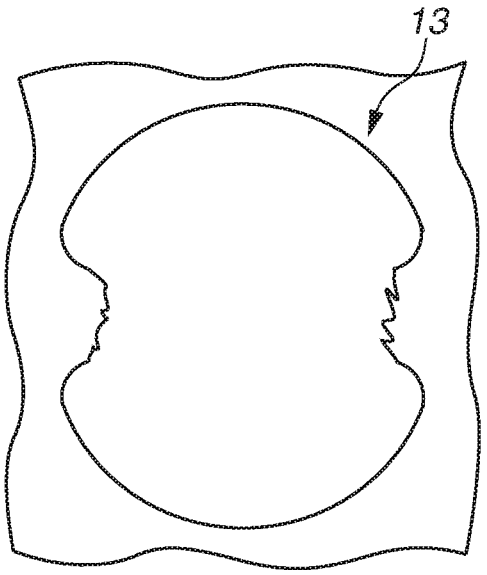
Figure 4:
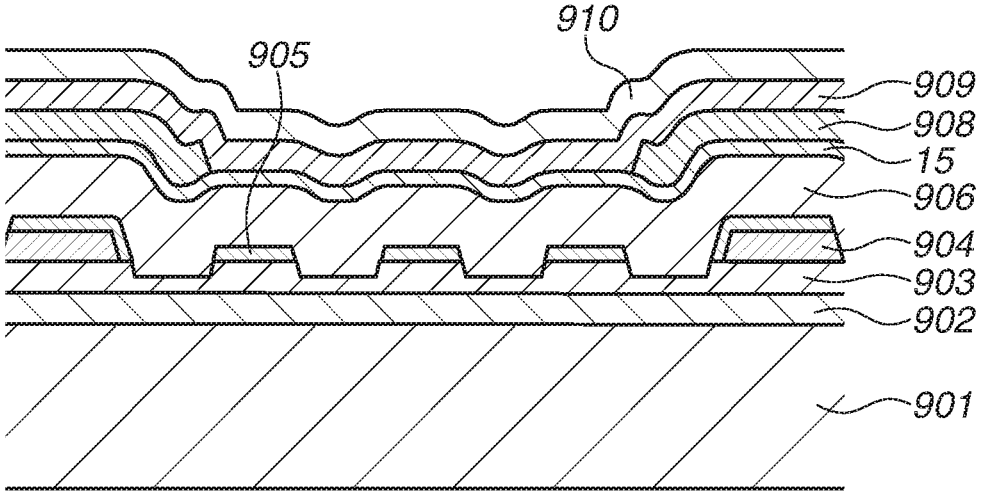
FIG. 4 is a diagram illustrating a detailed configuration of the recording element substrate.

Each of the recording element substrates 10 according to the present exemplary embodiment is described with reference to FIGS. 3A to 3C and FIG. 4. FIG. 3A is a schematic diagram illustrating a cross-section of one recording element substrate 10 according to the present exemplary embodiment. FIG. 3B is a schematic top view illustrating the ejection port 13 included in the recording element substrate 10 according to the present exemplary embodiment. FIG. 3C is a schematic diagram illustrating the ejection port 13 when protrusions 12 illustrated in FIG. 3B are damaged. FIG. 4 is an enlarged view of an area A illustrated in FIG. 3A.

The recording element substrate 10 mainly includes an ejection port forming member 4 provided with the ejection port 13 for ejecting the ink, and a substrate 901 provided with the heating element 15 and a temperature detection element 905. The temperature detection element 905 is an element (temperature sensor) for detecting temperature of the substrate 901. The substrate 901 further includes a liquid supply path 18, a liquid supply port 17, a liquid collection port 16, and a liquid collection path 19. The ink flows through an inside of the recording element substrate 10 in this order.

The ejection port 13 includes two protrusions 12 extending toward the inside of the ejection port 13. When the protrusions 12 are damaged by stress from outside, the protrusions 12 are chipped as illustrated in FIG. 3C. In such a state, satellite droplets may be increased, and recording quality may be deteriorated.

As illustrated in FIG. 4, a plurality of layers is formed on the substrate 901. More specifically, an insulating film phosphorous silicate glass (PSG) 903 is formed on the substrate 901 via a field oxide film 902 made of silicon dioxide ($SiO_2$). On the insulating film PSG 903, the temperature detection element 905 that includes a thin-film resistor made of aluminum (Al), platinum (Pt), titanium (Ti), tantalum (Ta), etc., and a first Al wiring 904 that connects and wires the temperature detection element 905. Further, an interlayer insulating film 906 made of silicon oxide (SiO) is provided as an upper layer. On the interlayer insulating film 906, the heating element 15 that is made of tantalum silicon nitride (TaSiN) and performs electrothermal conversion, and a second Al wiring 908 that connects the heating element 15 and a drive circuit provided on the substrate 901 are provided. In addition, a passivation film 909 made of $SiO_2$, and a cavitation resistant film 910 that is made of Ta, iridium (Ir), etc. to enhance cavitation resistance on the heating element 15 are provided.

The recording element substrate 10 having such a structure is formed by a semiconductor process. The recording element substrate 10 according to the present exemplary embodiment is produced in such a manner that film formation and patterning are performed while the temperature detection element 905 is placed on the first Al layer. Accordingly, the recording element substrate 10 can be produced without changing a structure of an existing recording element substrate.

<Ejection State>

A state where the ink is ejected from the ejection port 13 is described with reference to FIG. 5A. In FIG. 5A, (5A1) to (5A5) illustrate a state in a case where the ink is normally ejected from the ejection port having the protrusions 12 (hereinafter, referred to as normal ejection). When the ink is heated by the heating element 15, an air bubble 20 is generated in the ink. When the air bubble 20 is generated, the ink is ejected from the ejection port 13 by bubbling pressure of the air bubble 20. The air bubble 20 generated in the ink is immediately cooled by the surrounding ink. Accordingly, pressure inside the air bubble 20 becomes negative. As a result, force that returns the ejected ink to the ejection port acts, and a portion (hereinafter, referred to as droplet tail) 21 of the ink falls onto the substrate 901 as illustrated in (5A5). The droplet tail 21 falling onto the substrate 901 is low in temperature because the droplet is cooled through ejection to the atmosphere once. Thus, when the droplet tail 21 falls onto the substrate 901, the substrate 901 is rapidly cooled.

Figure 5:
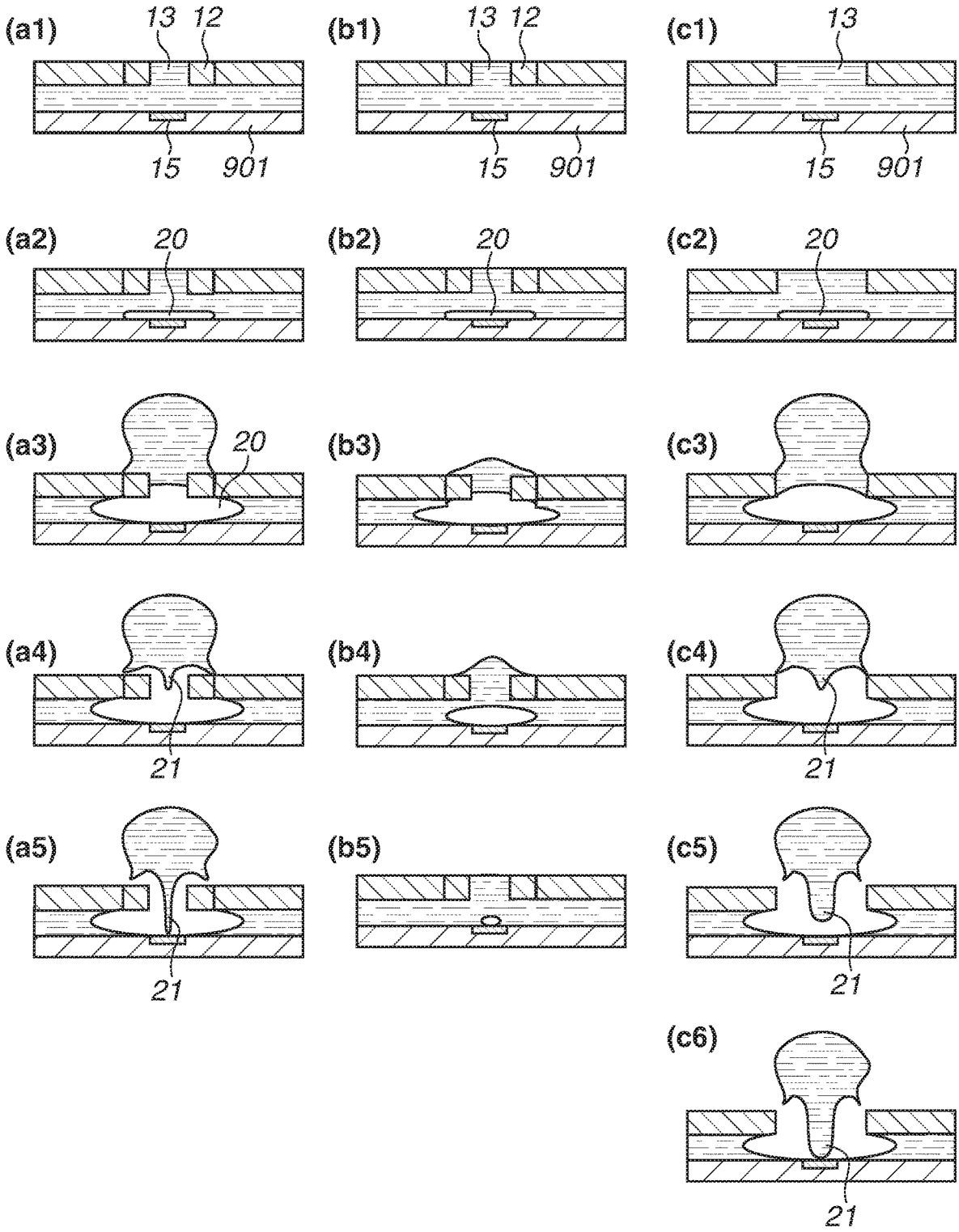
FIG. 5 is a diagram illustrating an ink ejection state.

In FIG. 5, (5B1) to (5B5) illustrate a state in a case where it is difficult for the ejection port 13 having the protrusions 12 to eject the ink due to solidification of the ink to the ejection port (hereinafter, referred to as non-ejection). When the ejection port 13 is in the non-ejection state, the ink that is ejected from the ejection port 13 and is cooled in the atmosphere does not fall onto the substrate 901. Accordingly, the substrate 901 is gently cooled with disappearance of the air bubble 20.

In FIG. 5, (5C1) to (5C6) illustrate a state where the ink is ejected from the ejection port 13 having the damaged protrusions 12 (hereinafter, referred to as protrusions damaged state). In a case where the protrusions 12 are damaged, timing at which the droplet tail 21 falls onto the substrate 901 and a falling amount of droplet tail are different from timing and a falling amount in a case where the protrusions 12 are not damaged. Accordingly, although the detail is described below, it is possible to know the state of the protrusions 12 (whether protrusions 12 are damaged) by detecting a change amount of temperature.

<Temperature Waveform of Substrate>

Figure 6A:
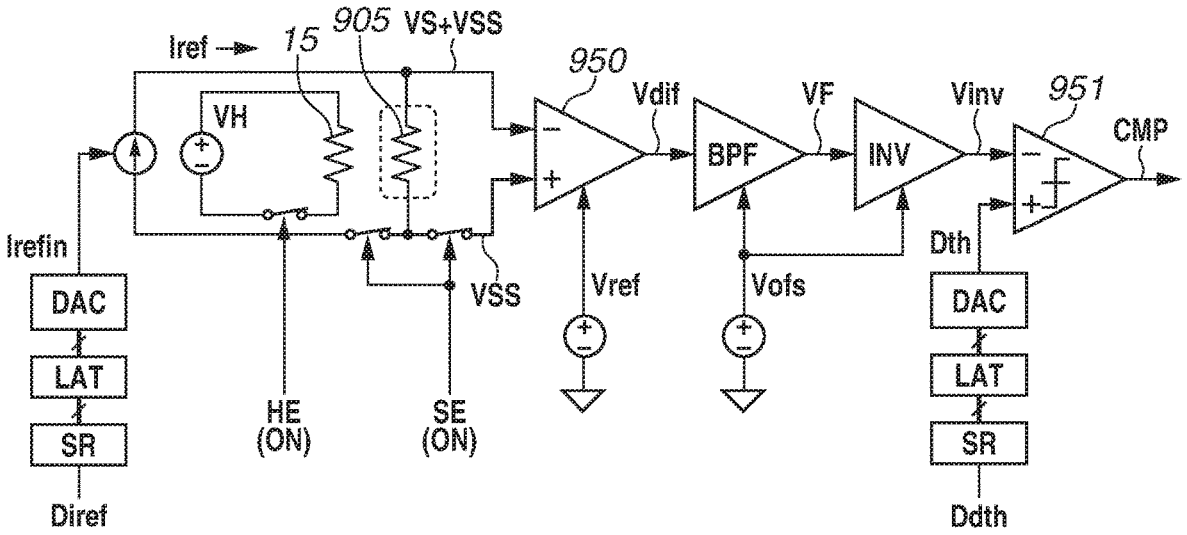
FIG. 6A is a diagram illustrating a circuit configuration around a temperature detection element.
Figure 6B:
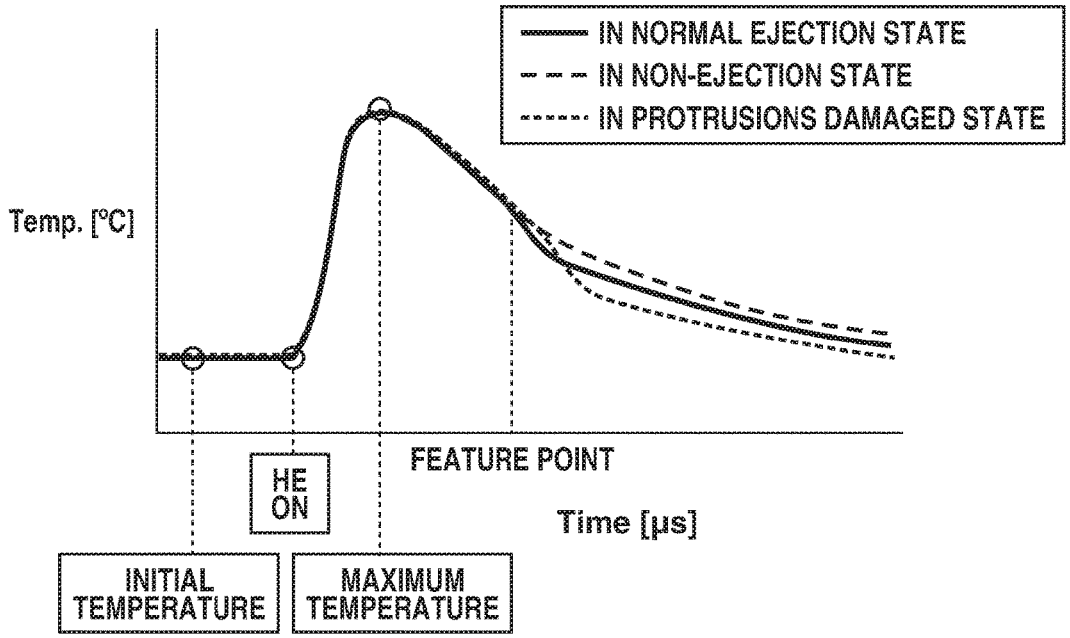
FIGS. 6B to 6D are graphs each illustrating a waveform acquired by the temperature detection element.
Figure 6C:
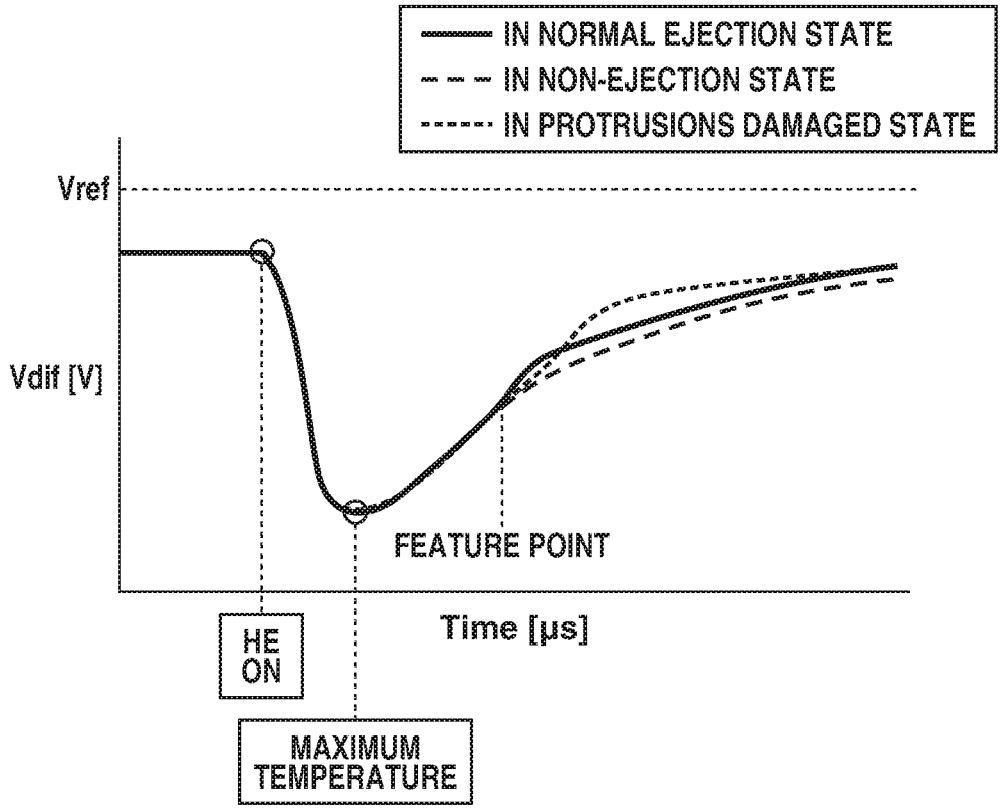
Figure 6D:
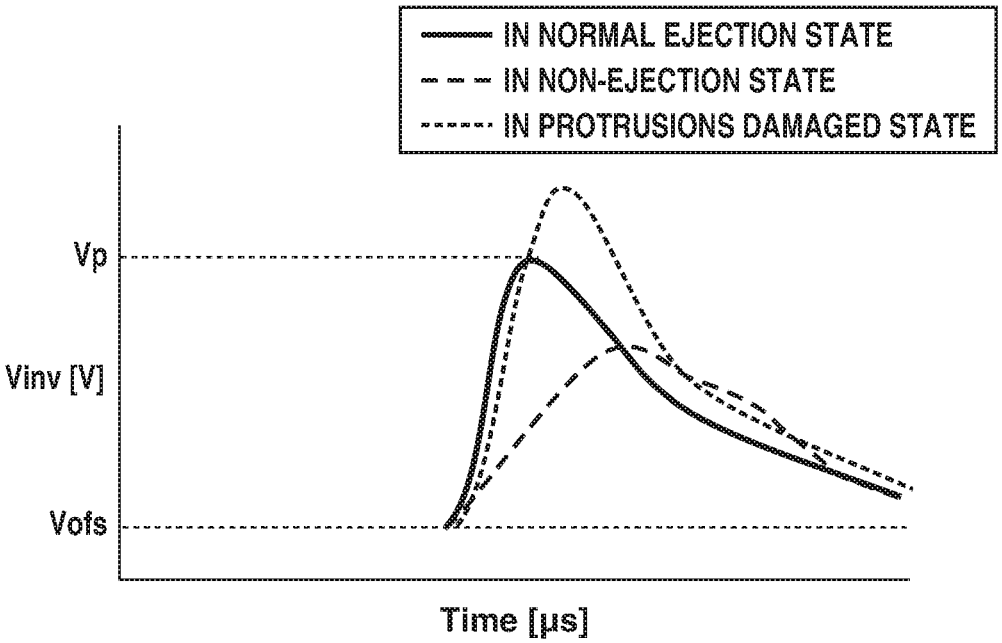

The temperature of the substrate 901 detected by the temperature detection element 905 is described with reference to FIGS. 6A to 6D. FIG. 6A is a diagram illustrating a circuit configuration around the temperature detection element 905. FIG. 6B illustrates a waveform of the temperature of the substrate 901 detected by the temperature detection element 905 when a voltage is applied to the heating element 15. FIG. 6C illustrates a voltage value corresponding to the temperature waveform illustrated in FIG. 6B. FIG. 6D is a diagram illustrating a temperature change amount with time in FIG. 6C.

The temperature detection element 905 is the thin film resistor. When a current is applied from a constant current source and a sensor selection signal SE is turned on (high active), a switch element is closed and a constant current Iref is applied to the temperature detection element 905. At the same time, voltage signals at both ends of the temperature detection element 905 are input to a differential amplifier. When the sensor selection signal SE is turned off (low), the switch element is opened to interrupt the application of the constant current Iref to the temperature detection element 905, and input of the voltage signals at the both ends of the temperature detection element 905 to the differential amplifier is also interrupted.

For example, the constant current Iref is settable in 32 stages from 0.6 mA to 3.7 mA at an interval of 0.1 mA. In the following description, a set width of one stage is referred to as one rank. In a case of a range having 32 ranks, a set value Diref of the constant current Iref is expressed with a digital value of 5 bits, and is transferred to a shift register in synchronization with a clock signal (not illustrated). Further, the set value is latched by a latch circuit at a timing by a latch signal (not illustrated), and is output to a current output type digital-to-analog converter DAC.

The output signal of the latch circuit is held until the next latch timing, and a next set value Diref is transferred to the shift register. An output current Irefin of the digital-to-analog converter DAC is input to the constant current source and is amplified by, for example, 12-folds. The amplified current is output as the constant current Iref.

A resistance Rs of the temperature detection element 905 at a temperature T is represented by the following expression (1), $$Rs=Rs0\{1+\mathrm{TCR}(T-T0)\}, \quad (1)$$

where T0 is normal temperature (25° C.), Rs0 is a resistance at that time, and TCR is a temperature resistance coefficient of the temperature detection element 905.

When the constant current Iref is applied to the temperature detection element 905, a differential voltage VS between the both ends is represented by the following expression (2).

$$VS=I\mathrm{ref}\cdot RS=I\mathrm{ref}\cdot RS0\{1+\mathrm{TCR}(T-T0)\} \quad (2)$$

The differential voltage VS is inversely input to a differential amplifier 950. In this state, however, an output Vdif becomes a negative voltage lower than or equal to a ground potential GND and the output Vdif becomes 0 V, and this output is actually fed back to a negative terminal of an operational amplifier inside the differential amplifier 950. As a result, an unexpected signal is finally output. To avoid such a situation, an offset voltage Vref that is sufficient to make the output Vdif greater than or equal to the ground potential GND is applied to the differential amplifier 950 by a constant voltage source.

As illustrated in FIG. 6C, the waveform is inverted upside down as the temperature waveform. Accordingly, a negative inclination represents a temperature rising process, and a positive inclination represents a temperature falling process. As illustrated in FIGS. 6B and 6C, a feature point at which temperature of a heating element 15 rapidly falls appears in the normal ejection state. It is considered that this is because a portion of the ejected liquid droplet falls onto the heating element 15 due to contraction of the bubble after bubbling. In contrast, in the non-ejection state, the temperature gently changes and the feature point does not appear. It is considered that this is because the above-described falling of the droplet does not occur in the non-ejection state.

The output Vdif of the differential amplifier 950 is then output to a filter circuit. The filter circuit is a circuit that converts the maximum gradient in the temperature falling process that represents the ejection state at the output Vdif, into a peak, and includes a band pass filter (BPF) in which a second-order low-pass filter and a first-order high-pass filter are connected in cascade. The low-pass filter attenuates high-frequency noise in a band higher than a cutoff frequency fcL. The high-pass filter extracts a gradient in the temperature falling process by performing first-order differentiation on a band lower than a cutoff frequency fcH, to remove a direct-current component. The filter circuit outputs a signal VF that is a reference to determine the normal ejection state and the non-ejection state, by the above-described signal processing.

At this time, the signal VF may become a negative voltage lower than or equal to the ground potential GND. For this reason, as described above, an offset voltage Vofs that is sufficient to make the signal VF greater than or equal to the ground potential GND is applied to a positive terminal from the constant voltage source. The output signal VF of the filter circuit is amplified by an inversion amplifier INV in a subsequent stage because a low-band signal is attenuated by the high-pass filter and the output voltage is lowered.

In the inversion amplifier INV, the input signal VF of the positive voltage is inverted to a negative voltage. For this reason, an offset voltage is applied to raise the signal in a manner similar to the high-pass filter. At this time, the output of the constant voltage source that applies the offset voltage Vofs to the high-pass filter is branched, and the same offset voltage Vofs is also applied to the inversion amplifier INV. As a result, an output signal Vinv of the inversion amplifier INV is represented by the following expression (3), $$V\mathrm{inv}=V\mathrm{ofs}+G\mathrm{inv}(V\mathrm{ofs}-VF), \quad (3)$$

where Ginv is an amplification factor of the inversion amplifier INV.

FIG. 6D illustrates a profile of the output signal Vinv in each of the normal ejection state, the non-ejection state, and the protrusions damaged state. In the normal ejection state, a peak voltage value Vp that is caused by the maximum temperature falling speed after the feature point appears. In the non-ejection state, the temperature falling speed is low because the feature point does not appear, and a peak appearing in the waveform is smaller than the peak in the normal ejection state. The output signal Vinv of the inversion amplifier INV is input to a positive terminal of a comparator 951, and is compared with a threshold voltage Dth input to a negative terminal. When Vinv>Dth is satisfied, the comparator 951 outputs a valid signal CMP.

For example, the threshold voltage Dth is settable in 256 ranks from 0.5 V to 2.54 V at an interval of 8 mV. In a case of a range having 256 ranks, a set value Ddth of the threshold voltage Dth is expressed by a digital value of 8 bits, and is transferred to a shift register in synchronization with a clock signal (not illustrated). Further, the set value is latched by a latch circuit at a timing by a latch signal (not illustrated), and is output to a voltage output digital-to-analog converter DAC. The output signal of the latch circuit is held until the next latch timing, and a next set value Ddth is transferred to the shift register during that time period.

The peak voltage value Vp of the output signal Vinv is detected by the comparator 951 by a procedure described below. First, during a first latch period, a driving pulse is applied to the heating element 15 in a state where a constant current iref0 (e.g., 1.6 mA) corresponding to a reference set value Diref0 is applied to the temperature detection element 905. At this time, a reference set value Ddth0 corresponding to a threshold voltage Dth0 as a reference is input to the comparator 951, and is compared with the peak of the output signal Vinv.

After the determination pulse CMP is output, the rank of the threshold voltage Dth is raised by one in the next latch period, and comparison with the peak of the output signal Vinv is similarly performed. The process is repeated until the determination pulse CMP is not output, and the threshold voltage Dth at the rank at which the determination pulse CMP is output at last is determined as the peak voltage value Vp. For example, to detect the peak voltage value Vp in the normal dejection state in FIG. 9D, the threshold voltage is raised from Dth0 to Dth1, Dth2, . . . in this order. As a result, the determination pulse CMP is not output at the threshold voltage Dth5. Thus, the threshold voltage Dth4 at which the determination pulse CMP is output last is determined as the peak voltage value Vp.

On the other hand, when the determination pulse CMP is not output in the first latch period, the rank of the threshold voltage Dth is lowered by one in the next latch period, and comparison with the peak of the output signal Vinv is similarly performed.

The process is repeated until the determination pulse CMP is output, and the threshold voltage Dth at the rank at which the determination pulse CMP is output is determined as the peak voltage value Vp. In the example of the normal ejection state in FIG. 9D, the threshold voltage Dth is lowered to Dth5 and Dth4. As a result, the determination pulse CMP is output at the threshold voltage Dth4. Accordingly, the threshold voltage Dth4 is determined as the peak voltage value Vp.

<Method of Inspecting Damage of Protrusion>

Figure 7:
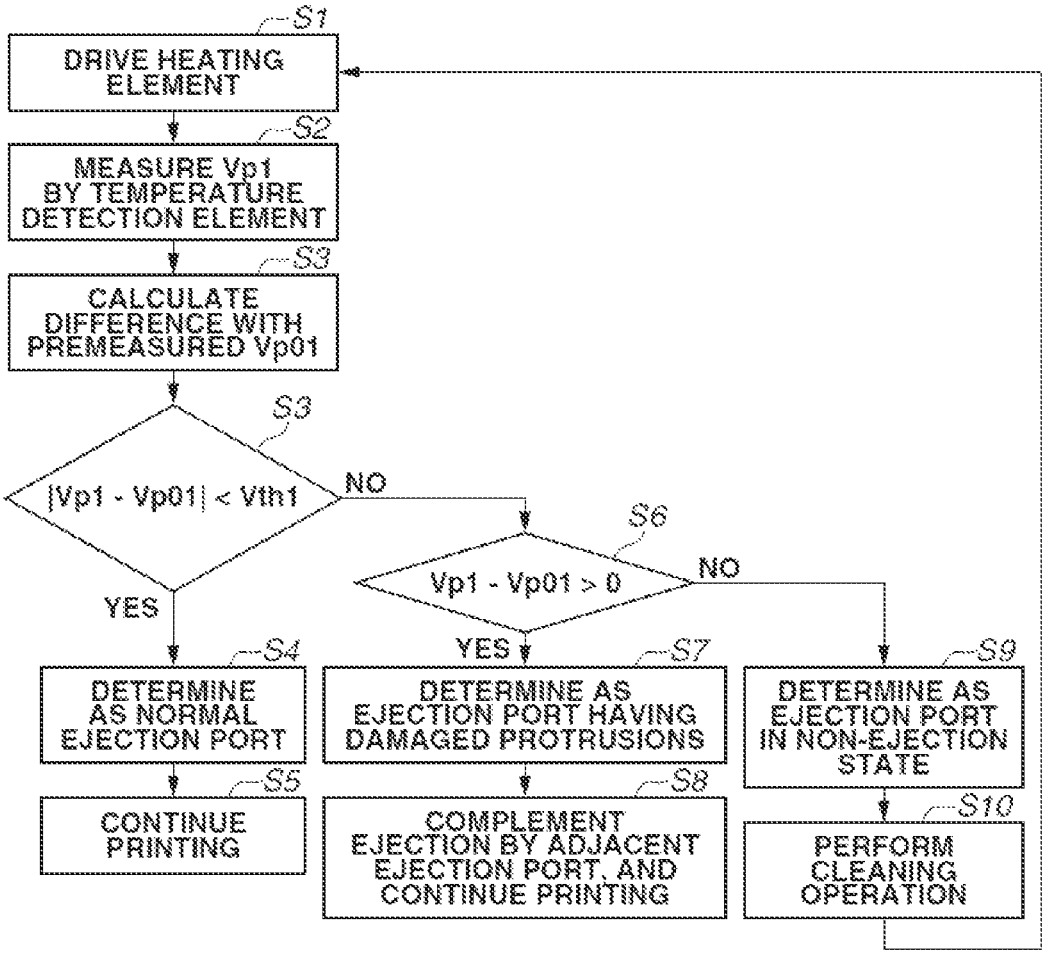
FIG. 7 is a flowchart according to the first exemplary embodiment.

A recording apparatus control method in which it is inspected whether the protrusions 12 are damaged, and the heating element 15 is controlled based on a result of the inspection is described with reference to FIGS. 6A, 6B, 6C, and 6D, and FIG. 7. FIG. 7 is a flowchart illustrating a method of determining whether the protrusions 12 are damaged, according to the present exemplary embodiment.

First, in step S1, driving operation to drive the heating element 15 is performed.

Next, in step S2, a peak voltage value Vp1 is measured by the temperature detection element 905. The peak voltage value Vp1 is a peak voltage value of the temperature of the substrate located at a position corresponding to the heating element 15 driven in step S1. Further, the substrate located at the position corresponding to the heating element 15 indicates a substrate between the driven heating element 15 and the temperature detection element 905 provided just below the heating element 15.

In step S3, a first comparison unit compares (calculates) a difference between the peak voltage value Vp1 measured in step S2 and a preset voltage value (premeasured peak voltage value obtained in normal ejection state) Vp01 (first comparison step).

In a case where a result of the calculation in step S3 satisfies the following expression (4) (YES in step S3), it is determined in step S4 that the ejection port can normally eject the ink.

$$|Vp1-Vp01|<Vth1, \quad (4)$$

where Vth1 is a preset threshold (determination threshold to determine whether the ejection port can normally eject ink). In a case where the ejection port can normally eject ink, the difference between the peak voltage value Vp1 and the preset voltage value Vp01 becomes small. As a result, the difference becomes lower than the determination threshold Vth1. In other words, the difference between the peak voltage value Vp and the preset voltage value Vp01 is within a predetermined range.

In a case where it is determined in step S3 that the ejection port is a normal ejection port, the heating element 15 is driven by the control element, and recording (printing) is continued in step S5.

In a case where the expression (4) is not satisfied (NO in step S3), a second comparison unit compares the value of Vp1−Vp01 with 0, and determines in step S6 whether the following expression (5) is satisfied (second comparison step).

$$Vp1-Vp01>0. \quad (5)$$

In a case where the expression (5) is satisfied (YES in step S6), it is determined in step S7 that the protrusions of the inspected ejection port are damaged. In the protrusions damaged state, the measured peak voltage value Vp1 becomes larger than the preset voltage value Vp01. Thus, the expression (5) is satisfied. In this case, the value of Vp1−Vp01 has a positive value outside the predetermined range.

In a case where it is determined in step S7 that the ejection port has the damaged protrusions, driving of the heating element 15 is controlled by the control element, and use of the ejection port is stopped (control step). Further, in step S8, the ejection operation of the ejection port having the damaged protrusions is complemented by an adjacent ejection port, and recording (printing) is continued.

Ina case where the expression (5) is not satisfied (NO in step S6), it is determined in step S9 that the inspected ejection port is in the non-ejection state. In the non-ejection state, the expression (5) is not satisfied because the measured peak voltage value Vp1 become lower than the preset voltage value Vp01. In this case, the value of Vp1−Vp01 has a negative value outside the predetermined range.

Ina case where it is determined that the ejection port is in the non-ejection state, driving of the heating element 15 is controlled to stop by the control element. Thereafter, in step S10, a cleaning unit performs recovery operation (cleaning operation) of the ejection port (cleaning step), and the operation in step S1 is started again. This is because, in the case where the ejection port is in the non-ejection state, it is not possible to determine whether the protrusions of the ejection port are damaged. After the cleaning operation is performed to address the non-ejection state and step S1 is started again, it is possible to determine whether the protrusions are damaged.

In FIG. 7, the first comparison step and the second comparison step are performed to inspect whether the protrusions are damaged, and driving of the heating element 15 is controlled based on a result of the inspection; however, the present exemplary embodiment is not limited thereto. In the present exemplary embodiment, the first comparison step and the second comparison step may be performed at the same timing. More specifically, the difference between the peak voltage value Vp1 and the preset voltage value Vp01 may be calculated, and driving of the heating element 15 may be controlled based on whether the difference has a positive value within or outside the predetermined range or a negative value outside the predetermined range. In this case, the value within the predetermined range indicates a case where the above-described expression (4) is satisfied, and a positive value or a negative value corresponds to whether the above-described expression (5) is satisfied or not.

Figure 8:
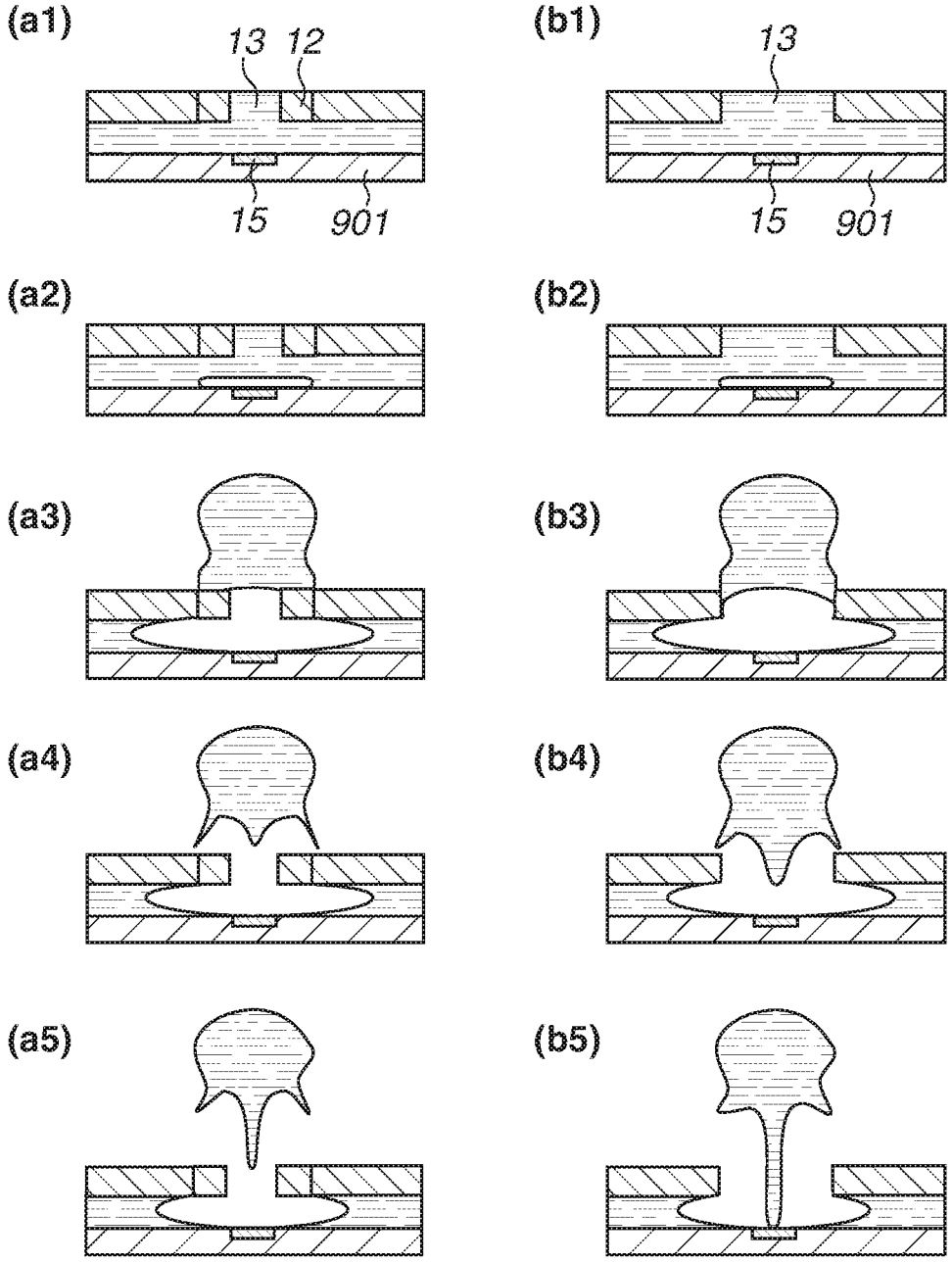
FIG. 8 is a diagram illustrating an ink ejection state according to a second exemplary embodiment.

A second exemplary embodiment of the present disclosure is described with reference to FIG. 8 to FIG. 10. Parts similar to the parts according to the first exemplary embodiment are denoted by the same reference numerals, and description thereof is omitted. In FIG. 8, (8A1) to (8A5) illustrate a state of ejection of the ink in the normal ejection state when the ink ejection speed is increased as compared with the example illustrated as (5A1) to (5C6) in FIG. 5. In FIG. 8, (8B1) to (8B5) illustrate a state of ejection of the ink in the protrusions damaged state when the ink ejection speed is increased.

When the ink ejection speed is increased, the ink is difficult to fall onto the substrate 901. However, in the state where the protrusions 12 are damaged, the droplet tail may fall even when the ejection speed is increased, as illustrated as (8B1) to (8B5) in FIG. 8.

Figure 9A:
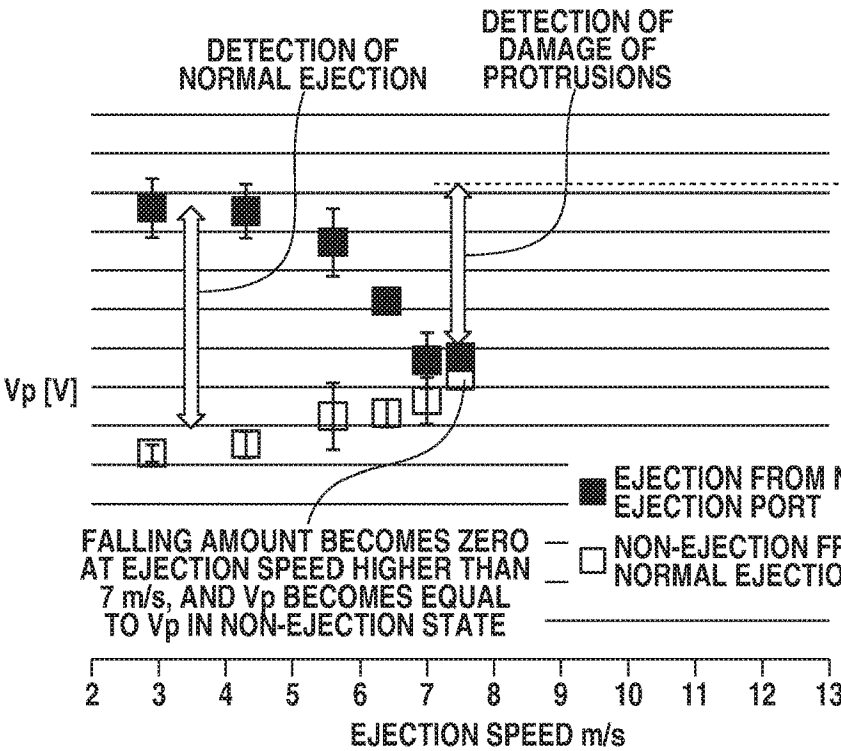
FIGS. 9A and 9B illustrate measurement results of a peak voltage according to the second exemplary embodiment.
Figure 9B:
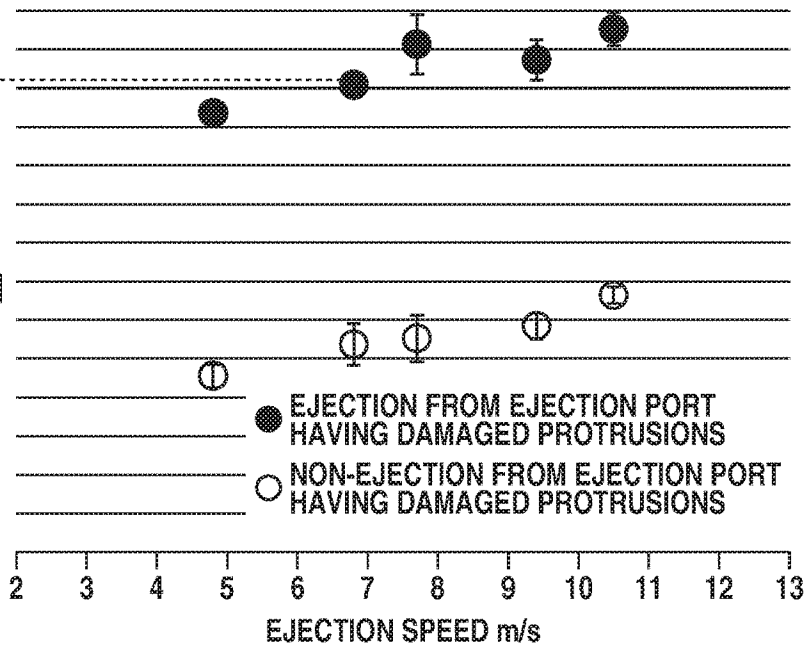

FIGS. 9A and 9B are diagrams illustrating a result when the peak voltage value Vp is measured while the ink ejection speed is varied. FIG. 9A illustrates the peak voltage value Vp obtained in the normal ejection state using the ejection port with the protrusions 12 not damaged, and the peak voltage value Vp obtained in a case where the ejection port is closed to establish a simulated non-ejection state. In the normal ejection state using the ejection port with the protrusions 12 not damaged, the falling amount of droplet tail is reduced as the speed is increased. The peak voltage value Vp is accordingly reduced as illustrated in FIG. 9A.

When the ejection speed becomes about 7 m/s, the droplet tail does not fall onto the substrate 901. As a result, the peak voltage value Vp becomes substantially equal to the peak voltage value Vp obtained in the simulated non-ejection state.

FIG. 9B illustrates the peak voltage value Vp obtained in a case where the ink is ejected from the ejection port having the damaged protrusions 12 and the peak voltage value Vp obtained in a case where the ejection port having the damaged protrusions 12 is closed to establish the simulated non-ejection state. As illustrated in FIG. 9B, in the case where the ink is ejected from the ejection port having the damaged protrusions 12, the peak voltage value Vp is not reduced even when the ink ejection speed is increased.

Figure 10:
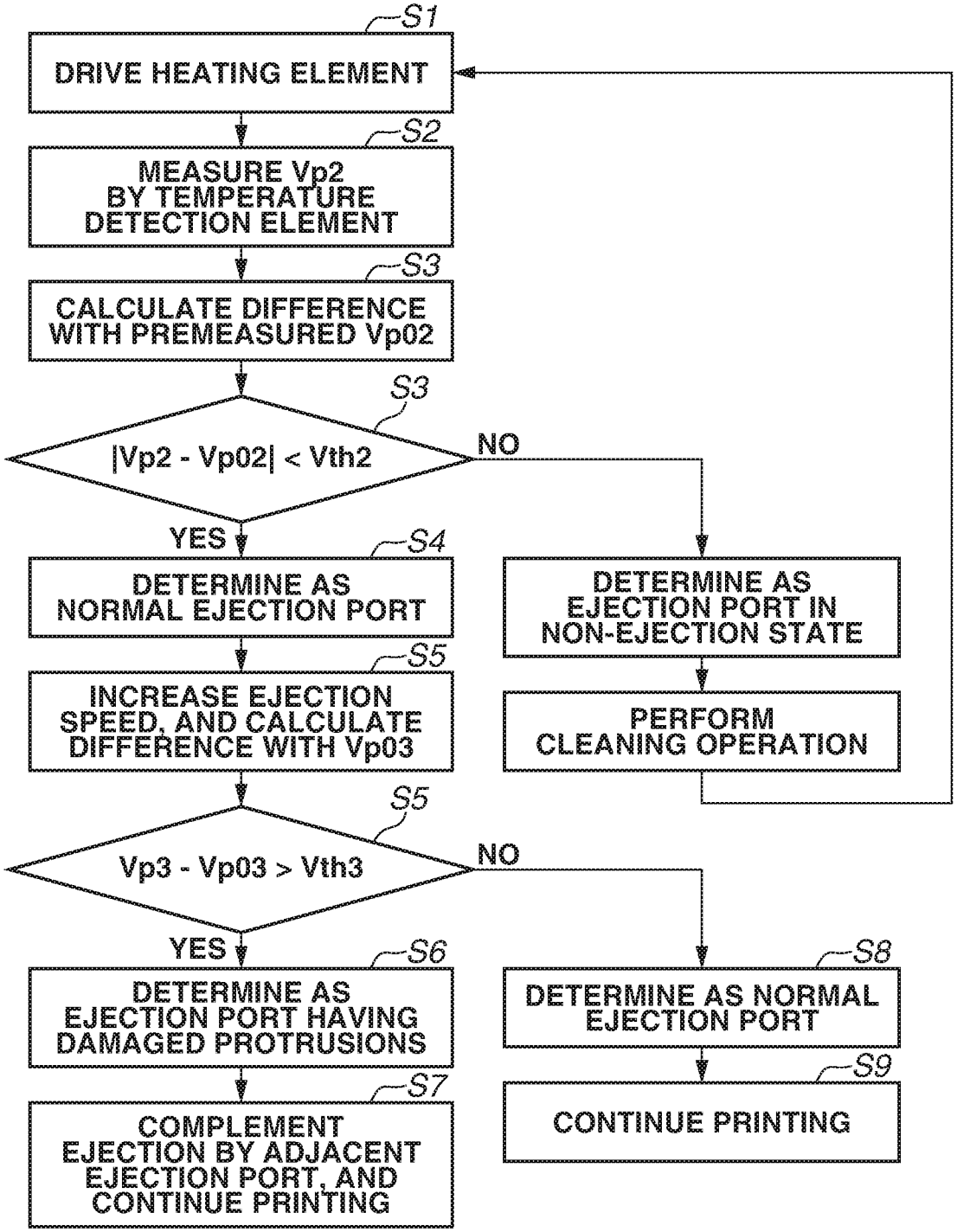
FIG. 10 is a flowchart according to the second exemplary embodiment.

FIG. 10 is a flowchart illustrating a method of determining presence/absence of damage of the protrusions based on the difference of the output value of the peak voltage value Vp obtained when the ink ejection speed is varied. In step S5, to determine whether the ejection port can eject the ink, the first comparison unit calculates a difference between a peak voltage value Vp2 when the ejection speed is reduced and a preset voltage value (premeasured peak voltage value obtained in normal ejection state) Vp02 (first comparison step). The ejection speed in the case where the ejection speed is reduced is, for example, 3 m/s to 5 m/s, and operation to drive the heating element 15 at the low ejection speed is defined as first driving operation.

In the case where the ejection port can eject the ink, the measured peak voltage value Vp2 and the premeasured peak voltage value Vp02 are not largely different. Therefore, in a case where the following expression (6) is satisfied (YES in step S3), it is determined in step S4 that the ejection port can eject the ink.

$$|Vp2-Vp02|<Vth2 \quad (6)$$

In the expression, Vth2 is a preset threshold (determination threshold to determine whether ejection port can eject ink), and is a difference value between the peak voltage obtained in the normal ejection state at the low ejection speed and the peak voltage obtained in the case where the ejection port is closed to establish the simulated non-ejection state.

Ina case where the expression (6) is not satisfied (NO in step S3), the processing returns to step S1 after the ejection port is cleaned, and the peak voltage value Vp2 and the preset peak voltage value Vp02 are compared again.

In the case where the expression (6) is satisfied, the second comparison unit then calculates a difference between a peak voltage value Vp3 measured when the ejection speed is increased and a preset voltage value (premeasured voltage value obtained in normal ejection state) Vp03 in step S5 (second comparison step). The ejection speed in the case where the ejection speed is increased is, for example, 6 m/s to 8 m/s, and the operation to drive the heating element 15 at the increased ejection speed is defined as second driving operation. In the case where the protrusions 12 are damaged, the peak voltage value Vp3 and the peak voltage value Vp03 are largely different. Therefore, in a case where the following expression (7) is satisfied (YES in step S5), it is determined in step S6 that the ejection port have the damaged protrusions 12, $$Vp3-Vp03>Vth3 \quad (7)$$

where Vth3 is a preset threshold (determination threshold to determine whether protrusions 12 are damaged), and is a difference value between the peak voltage obtained in the normal ejection state at the high ejection speed and the peak voltage obtained in the case where the protrusions are damaged.

In the case where it is determined that the ejection port has the damaged protrusions 12, driving of the heating element 15 is controlled by the control element, and use of the ejection port is stopped. Further, in step S7, ejection operation of the ejection port having the damaged protrusions 12 is complemented by an adjacent ejection port, and recording (printing) is continued.

According to the present disclosure, it is possible to prevent deterioration in recording quality due to damage of the protrusions.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-170514, filed Sep. 19, 2019, which is hereby incorporated by reference herein in its entirety.

What is claimed is:

1. A recording apparatus comprising:

a liquid ejection head, wherein the liquid ejection head includes:

an ejection port configured to eject liquid and including a protrusion extending toward an inside of the ejection port, a substrate including a heating element configured to heat the liquid to eject the liquid from the ejection port, a control element configured to control driving of the heating element, and a temperature detection element configured to detect temperature of the substrate, wherein, in a case where relations of $|Vp1-Vp01|>Vth1$ and $Vp1-Vp01>0$ are satisfied, the control element performs control not to drive the driven heating element, where Vp1 is a voltage value measured by the temperature detection element at a timing when a temperature change amount becomes maximum in a temperature falling process of the substrate located, after a driving operation to drive the heating element, at a heating element position corresponding to the heating element driven in the driving operation, Vp01 is a preset voltage value, and Vth1 is a preset threshold, and wherein, in a case where relations of $|Vp1-Vp01|>Vth1$ and $Vp1-Vp01<0$ are satisfied, the control element performs control not to drive the driven heating element.

2. A recording apparatus comprising:

a liquid ejection head, wherein the liquid ejection head includes:

an ejection port configured to eject liquid and including a protrusion extending toward an inside of the ejection port, a substrate including a heating element configured to heat the liquid to eject the liquid from the ejection port, a control element configured to control driving of the heating element, and a temperature detection element configured to detect temperature of the substrate, wherein, in a case where relations of $|Vp1-Vp01|>Vth1$ and $Vp1-Vp01>0$ are satisfied, the control element performs control not to drive the driven heating element, where Vp1 is a voltage value measured by the temperature detection element at a timing when a temperature change amount becomes maximum in a temperature falling process of the substrate located, after a driving operation to drive the heating element, at a heating element position corresponding to the heating element driven in the driving operation, Vp01 is a preset voltage value, and Vth1 is a preset threshold; and a cleaning unit configured to clean the ejection port, wherein the cleaning unit cleans the ejection port in a case where relations of $|Vp1-Vp01|>Vth1$ and $Vp1-Vp01<0$ are satisfied.

3. A method to control a recording apparatus that includes a liquid ejection head, wherein the liquid ejection head includes an ejection port configured to eject liquid and including a protrusion extending toward an inside of the ejection port, a substrate including a heating element configured to heat the liquid to eject the liquid from the ejection port, and a temperature detection element configured to detect temperature of the substrate, the method comprising:

performing control, in a case where relations of $|Vp1-Vp01|>Vth1$ and $Vp1-Vp01>0$ are satisfied, not to drive the driven heating; element, where Vp1 is a voltage value measured by the temperature detection element at a timing when a temperature change amount becomes maximum in a temperature falling process of the substrate located, after a driving operation to drive the heating element, at a heating element position corresponding to the heating element driven in the driving operation, Vp01 is a preset voltage value, and Vth1 is a preset threshold, wherein, in a case where relations of $|Vp1-Vp01|>Vth1$ and $Vp1-Vp01<0$ are satisfied, the control element performs control not to drive the driven heating element.

4. The method according to claim 3, further comprising cleaning the ejection port in a case where the relations of $|Vp1-Vp01|>Vth1$ and $Vp1-Vp01<0$ are satisfied.

* * * * *